US005346421A

United States Patent [19]

Yeh

[11] Patent Number: 5,346,421

[45] Date of Patent: Sep. 13, 1994

[54] TOY BIRD CAPABLE OF DRINKING WATER AND PRODUCING SOUND

[76] Inventor: Thomas Yeh, 10F, No. 97, Sec. 2, Nan-Gun Rd., Taipei, Taiwan

[21] Appl. No.: 185,147

[22] Filed: Jan. 24, 1994

[51] Int. Cl.[5] ..... A63H 13/00; A63H 33/00; A63H 5/00; A63H 3/52

[52] U.S. Cl. ..... 446/199; 446/14; 446/213; 446/267; 446/297

[58] Field of Search ..... 446/14, 176, 199, 213, 446/267, 297, 322, 325, 396, 487, 491; 434/276, 283, 300

[56] References Cited

U.S. PATENT DOCUMENTS 2,240,906 5/1941 Harold ..... 446/14
2,402,463 6/1946 Sullivan ..... 446/14

FOREIGN PATENT DOCUMENTS 958409 3/1950 France ..... 446/267
451145 3/1950 Italy ..... 446/199

*Primary Examiner*—Robert A. Hafer

*Assistant Examiner*—Jeffrey D. Carlson

*Attorney, Agent, or Firm*—Browdy and Neimark

[57] ABSTRACT

A toy bird capable of drinking water and producing sound is composed of a base and a hollow tubular body. The base is provided with two limbs having a support hole located at the top thereof. The hollow tubular body comprises a head located at the top thereof, a spherical container located at the bottom thereof, and a middle tube located between the head and the spherical container. The middle tube is provided centrally and horizontally with an electrically conductive support rod having two ends received in the support holes of the two limbs. The base contains a sound device comprising a sound circuit, a speaker and batteries. The two limbs are provided respectively with a conducting element. The support rod has two ends provided respectively with a curved segment capable of triggering the sound device to produce a tooting sound at the time when the support rod is caused to swivel along with the tubular body so that the curved segments of the two ends of the support rod make contact with two top ends of the two conducting elements simultaneously.

2 Claims, 3 Drawing Sheets

TOY BIRD CAPABLE OF DRINKING WATER AND PRODUCING SOUND

FIELD OF THE INVENTION

The present invention relates generally to a toy bird, and more particularly to a toy bird capable of drinking water and producing sound.

BACKGROUND OF THE INVENTION

The are a variety of toy birds available in the toy shops. Some of the toy birds are capable of drinking water by means of a tube having one end that is connected with the head of the toy birds and having another end in communication with a container holding the liquid. As the beak of a toy bird is dipped into water to cause a differential in temperature between both ends of the tube, the liquid is caused to rise in the tube to enter the head of the toy bird so that the beak of the toy bird is caused to dip into water. Thereafter, the liquid is caused to flow back to the bottom end of the tube so as to cause the toy bird to be in an upright position. The liquid is once again caused to rise slowly in the tube to make the toy bird drink the water. In other words, such a toy bird as described above is capable of doing a water-drinking trick in a reciprocating manner. However, it is conceivable that the conventional water-drinking toy birds are rather monotonous and lacking in imagination.

SUMMARY OF THE INVENTION

It is therefore the primary objective of the present invention to make a water-drinking toy bird more amusing by providing the toy bird with a hidden sound device capable of tooting after the toy bird has completed each water-drinking trick.

It is another objective of the present invention to provide a water-drinking toy bird with a sound device which can be easily assembled and disposed in the toy bird.

The foregoing objectives of the present invention are attained by a water-drinking toy bird having a base which is provided with a sound circuit. The interior of the toy bird is connected with the sound circuit. Located in the interior of the bird-shaped body are two electricity conducting wire ends. A metal support rod is fixed in the center of the tubular body of the toy bird. The metal support rod has both ends that are inserted into two supporting holes in which the two electricity conducting wire ends are located respectively. As the tube is caused to swivel a predetermined angle, both ends of the support rod are in contact with the two electricity conducting wire ends so as to trigger the sound circuit to toot for a predetermined period of time.

DETAILED DESCRIPTION OF THE INVENTION

Figure 1:
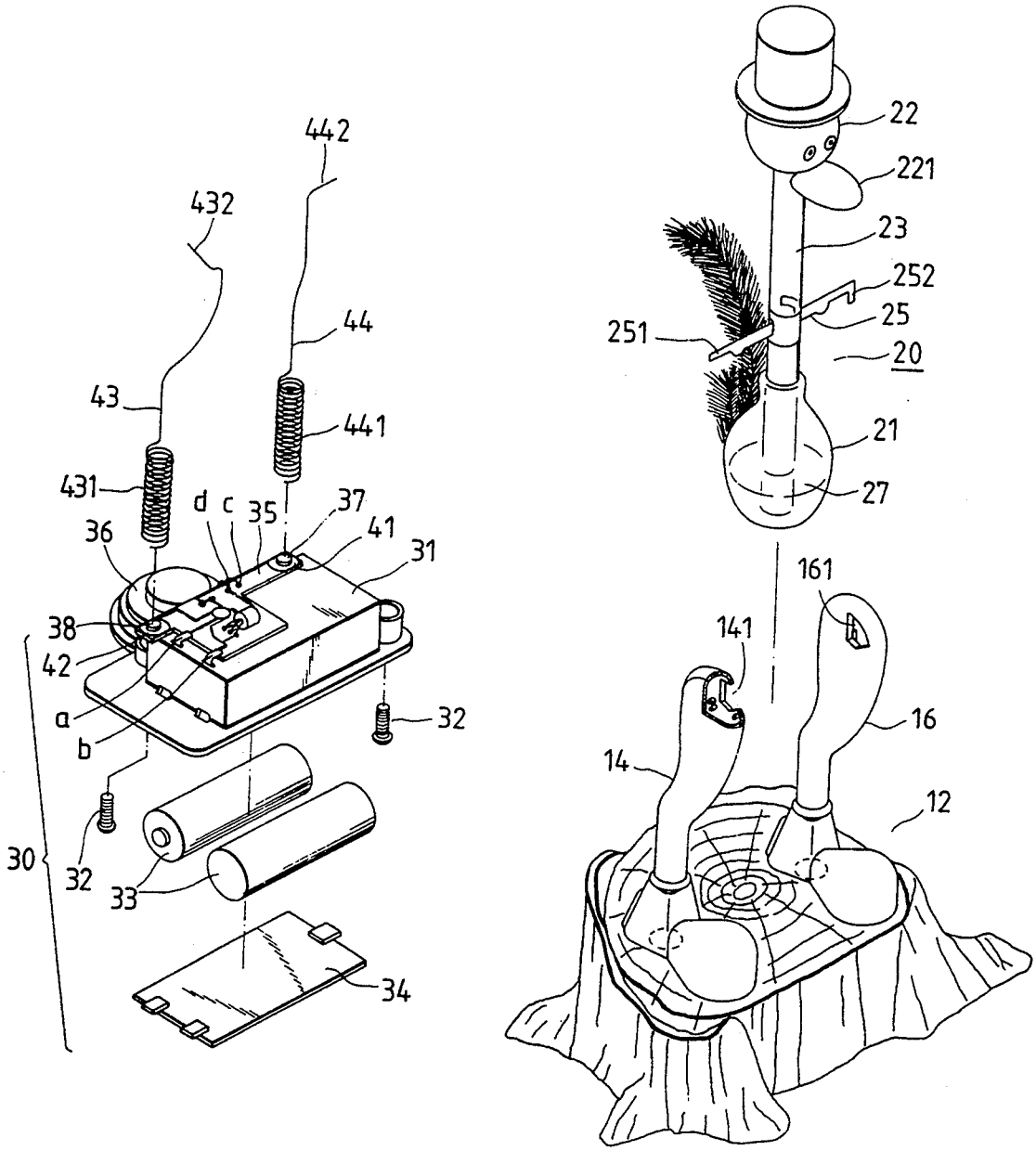
FIG. 1 shows an exploded view of the present invention.
Figure 2:
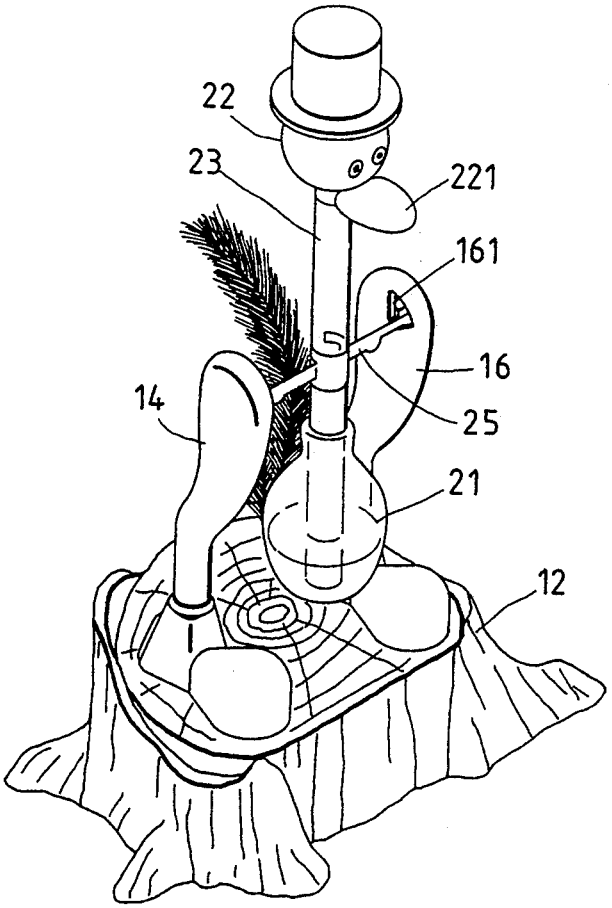
FIG. 2 shows a perspective view of the present invention in combination.

As shown in FIGS. 1–5, a toy bird of the present invention comprises: a base 12 provided with two limbs 14 and 16 which are in turn provided respectively at the top thereof with two support holes 141 and 161; and a hollow transparent tubular body 20 of a glass material and having at the bottom end thereof a spherical container 21 and at the top thereof a head 22. Located between the spherical container 21 and the head 22 is a middle tube 23 which is provided centrally with a horizontal metallic support rod 25 having two ends which are received respectively in the two support holes 141 and 161. The spherical container 21 is used to hold therein a temperature-sensitive liquid 27, which can be caused to rise to enter the head 22 by a differential in temperature between the spherical container 21 and the head 22. As a result, the head 22 is caused to swivel downwards so that the beak 221 is dipped into the water contained in a cup 29. As the beak 221 is moistened, the liquid in the head 22 is caused by the slanted middle tube 23 to flow back to the spherical container 21. The hollow tubular body 20 is therefore caused to swivel in a reciprocating manner by the rising and the descending of the liquid 27.

The base 12 of the present invention is provided with a sound device 30 comprising a battery housing 31, which is fastened securely to the base 12 by means of a plurality of screws 32. The batteries 33 are housed in the battery housing 31 provided with a cover 34. The sound device 30 is provided with a sound circuit board 35 and a speaker 36. The sound circuit board 35 has a sound control circuit which is connected respectively with the batteries 33 and the speaker 36 at the connection points a, b, and c, d. The circuit board is provided at both ends thereof with two circular holes dimensioned to fit over two cylindrical columns 37 and 38, which are provided with conducting surfaces 41 and 42. Two conducting elements 43 and 44 are disposed in the hollow interiors of the two limbs 14 and 16 and are provided at the bottoms thereof with the coil springs 431 and 441 for making contact with the two conducting surfaces 41 and 42. The top end 432 of the conducting element 43 is so curved as to be located in the support hole 141 to make contact with a right end 251 of the support rod 25. The top end 442 of another conducting element 44 is so curved as to be located by the side of the support hole 161 without making contact with a left end 252 of the support rod 25.

Figure 3:
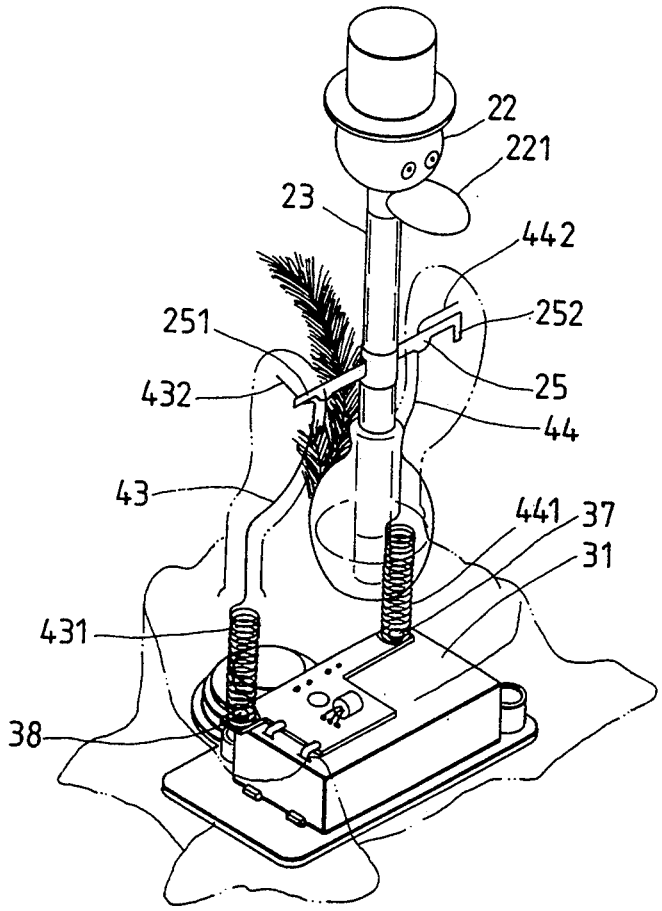
FIG. 3 shows a schematic view of component parts of the present invention in combination.
Figure 4:
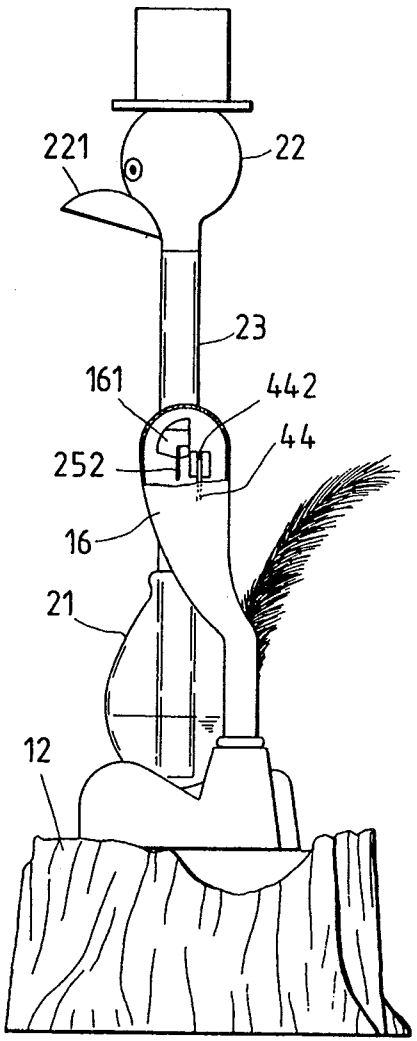
FIG. 4 shows a side schematic view of the present invention in an upright position.

As shown in FIG. 3, when the hollow tubular body 20 is in an upright position, the right end 251 of the support rod 25 is in contact with the top end 432 of the conducting element 43. However, the left end 252 of the metallic support rod 25 is not in contact with the top end 442 of the conducting element 44. As a result, the two conducting elements 43 and 44 are not in communication with each other. In other words, the sound circuit is not at work in view of the fact that the two conducting surfaces 41 and 42 are not in communication with each other.

Figure 5:
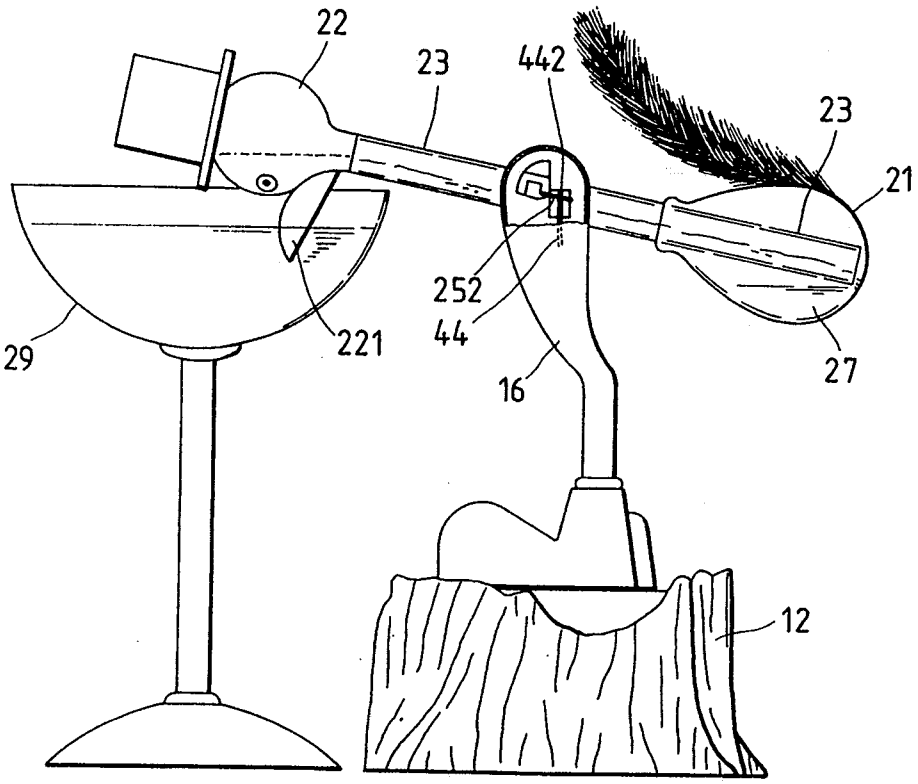
FIG. 5 shows a side schematic view of the present invention in a water-drinking position.

As shown in FIG. 5, when the tubular body 20 is caused to swivel downwards to make the beak 221 of the head 22 dip into the water, the curved segment of the left end 252 of the support rod 25 touches the top end 442 of the conducting element 44, thereby causing the two conducting elements 43 and 44 to be in communication with each other via the support rod 25. In other words, the conducting surfaces 41 and 42 are in communication with each other so as to activate the sound device 30 to produce a bird's tooting sound through the speaker 36.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. A toy bird capable of appearing to drink water and producing sound and comprising: a base provided thereon with two limbs, each of which has a support hole located at a top end of a hollow interior thereof; a hollow tubular body having a head located at the top end thereof, a spherical container located at the bottom end thereof, and a middle tube located between said head and said spherical container for holding therein a liquid, said middle tube being provided centrally and horizontally with a support rod having two ends dimensioned to fit into said two support holes of said two limbs; wherein said base is provided with a sound device comprising a battery housing, a sound circuit board and a speaker; wherein said two limbs are provided respectively with a conducting element making contact at a bottom thereof with two predetermined contact points of said sound circuit board, said conducting elements each having a top extending to reach the periphery of said two support holes; and wherein said support rod has two ends, each of which is provided with a curved segment capable of triggering said sound device to produce a tooting sound at the time when said support rod is caused to swivel along with said tubular body so that said curved segments of said two ends of said support rod make contact with two top ends of said two conducting elements simultaneously.

2. The toy bird of claim 1 wherein each of said two conducting elements is a conductive wire with a coiled bottom end.

* * * * *